US007406749B2

(12) United States Patent
Herper

(10) Patent No.: US 7,406,749 B2
(45) Date of Patent: Aug. 5, 2008

(54) MULTI-LINK HINGE

(75) Inventor: Markus Herper, Mühltal (DE)

(73) Assignee: Mepla-Werke Lautenshlaeger GmbH & Co., KG, Reinheim (DE)

( * ) Notice: Subject to any disclaimer, the term of this patent is extended or adjusted under 35 U.S.C. 154(b) by 167 days.

(21) Appl. No.: 10/512,115

(22) PCT Filed: Apr. 23, 2003

(86) PCT No.: PCT/EP03/04190

§ 371 (c)(1),
(2), (4) Date: Oct. 21, 2004

(87) PCT Pub. No.: WO03/093616

PCT Pub. Date: Nov. 13, 2003

(65) Prior Publication Data

US 2005/0177980 A1 Aug. 18, 2005

(30) Foreign Application Priority Data

May 3, 2002 (DE) ..... 202 07 036 U

(51) Int. Cl.
*E05D 15/00* (2006.01)

(52) U.S. Cl. ..... 16/368; 16/54; 16/287; 16/286

(58) Field of Classification Search ..... 16/368, 16/54 X, 49, 287 X, 286 X, 50; 312/109, 312/326, 329
See application file for complete search history.

(56) References Cited

U.S. PATENT DOCUMENTS 3,362,042 A * 1/1968 Arturo ..... 16/278
3,772,736 A * 11/1973 Hettich et al. ..... 16/288
4,023,623 A * 5/1977 Anderson ..... 172/311
4,075,735 A * 2/1978 Rock et al. ..... 16/278
4,083,082 A * 4/1978 Holmes ..... 16/288
4,251,900 A * 2/1981 Lautenschlager ..... 16/294

(Continued)

FOREIGN PATENT DOCUMENTS

DE 101 59 140 A1 7/2002

(Continued)

*Primary Examiner*—Patricia Engle
*Assistant Examiner*—Mark Williams
(74) *Attorney, Agent, or Firm*—Christa Hildebrand; Norris McLaughlin & Marcus, P.A.

(57) ABSTRACT

The invention relates to a multi-link hinge (10) for hinging a door leaf (12) to the body of a piece of furniture with a body fitting which may be fixed to the support wall (14) of the body and a door leaf fitting (20) connected to the above by means of a joint mechanism. The support wall fitting, embodied as an extended support arm is arranged on a fitting plate (18) which may be fixed to the support wall of the body and coupled to the door leaf fitting, embodied as a hinge cup fitted in a recess in the back face of the door leaf (12), by means of the joint mechanism, embodied with two joint arms (22; 24) each connected to one of the fittings such as to pivot. A damping device acts on a support wall side hinge piece, for example the body fitting (16) or the fixing plate (18) and one of the joint arms (24), at least during a locking part of the pivoting motion of said joint arm on a closing or opening motion of the door leaf fitting (20).

8 Claims, 3 Drawing Sheets

U.S. PATENT DOCUMENTS

| | | | | | |
|---|---|---|---|---|---|
| 4,295,245 | A * | 10/1981 | Malcom | 16/80 |
| 4,837,894 | A * | 6/1989 | Lin | 16/288 |
| 5,012,551 | A * | 5/1991 | Beneke et al. | 16/49 |
| 5,035,026 | A * | 7/1991 | Carlo et al. | 16/288 |
| 5,058,238 | A * | 10/1991 | Lautenschlager | 16/278 |
| 6,243,918 | B1 * | 6/2001 | Zetti | 16/298 |
| 6,591,454 | B2 * | 7/2003 | Brustle | 16/374 |
| 6,684,453 | B2 * | 2/2004 | Wang | 16/54 |
| 7,065,833 | B2 * | 6/2006 | Kropf | 16/286 |
| 7,096,535 | B2 * | 8/2006 | Lin | 16/287 |

FOREIGN PATENT DOCUMENTS

| | | | |
|---|---|---|---|
| EP | 1375797 | A1 * | 1/2004 |
| WO | WO 2004020771 | A1 * | 3/2004 |

* cited by examiner

MULTI-LINK HINGE

This application is a 371 of PCT/EP03/04190, filed Apr. 23, 2003.

The invention relates to a universal joint hinge for the articulation of a door leaf on the carcass of a piece of furniture with a mounting plate which is disposed on the supporting wall of the carcass and on which a carcass mounting part constructed as an elongated support arm is connected to a universal joint mechanism and the door leaf mounting part is constructed as a hinge cup, wherein the universal joint mechanism has two joint arms which in their central region are pivotable relative to one another like scissors and of which each one is pivotable at one of its ends about a fixed axis on one of the mounting parts and at the respective other end is attached to the respective other mounting part so as to be variable in position along a predetermined space curve extending in a plane lying at right angles to the pivot axis of the hinge.

In known universal joint hinges the end of the joint arm lying opposite the end of this joint arm which is attached so as to be directly pivotable on one of the mounting parts is attached so as to be variable in position either indirectly by way of an interposed coupling link, the ends of which are pivotably articulated on the one hand on the end of the joint arm and on the other hand on the mounting part to be attached, or alternatively by way of a rocker-like sliding guide at least of the joint arm to be attached so as to be variable in position on the carcass mounting part. In this case such universal joint hinges can also be provided with a latch bolt mechanism of different design which, when a door leaf fixed on the carcass of a piece of furniture with such universal joint hinges is closed, as the door leaf approaches the closed position allows the door leaf to snap into the closed position after overcoming a pressure point and keeps it in this position (DE 25 52 729 C2). The shock-like impact of the door leaf on the carcass as it snaps into the closed position puts abrupt stress in particular on the bearing points of the hinge links. Also when the door leaf is opened vigorously if it is not deliberately slowed down by the person accessing the cupboard does as it approaches the fully open position such shock-like stresses can occur in the hinge, which can attain a considerable magnitude due to the comparatively large lever arm of the kinetic inertial force of the door leaf to be set in the centre of gravity of the door leaf by comparison with the effective lever arms of the links of the joint mechanism.

The object of the invention, therefore, is to provide universal joint hinges with an integrated damping device which, as the door leaf approaches at least one of its end positions, exhibits a damping effect which reduces shock stresses which occur at least to an extent which does not cause damage.

Starting from the known joint hinges of the type referred to in the introduction, this object is achieved according to the invention in that the joint arm which is mounted so as to be pivotable about a fixed axis on or in the door leaf mounting part is mounted at its opposite end coupled to the carcass mounting part so as to be pivotable about a fixed axis on or in the end region of the carcass mounting part inside the carcass, that the portion of the joint arm which is positioned between the region which is pivotably mounted on the carcass mounting part and the region which supports the joints arms so that they pivot approximately centrally like scissors comprises two joint arm portions which are longitudinally displaceable relative to one another by a predetermined amount, and that a damping device which is effective at least during a part of the displacement movement of the joint arm portions relative to one another is provided between the two joint arm portions.

Because according to the invention the joint arm/lever arm which is attached so as to be variable in position on the carcass mounting part is divided into two joint arm portions which are longitudinally displaceable relative to one another, the effective lever length of this lever arm changes during the opening and closing movement, so that the interposition of a coupling link or the coupling by way of a rocker-like sliding guide according to the prior art is not necessary. Because of the relative displacement of the two joint arm portions during pivoting of the hinge, the arrangement of the damper device between these two joint arm portions is convenient.

In this case the joint arm portions which are displaceable relative to one another are advantageously constructed so that they interengage telescopically.

In this case it is advantageous if one joint arm portion is formed by an elongated cylinder which is disposed so as to be longitudinally displaceable on a piston rod which forms the other joint arm portion.

The piston rod is then advantageously attached integrally on the central region pivotably coupled in scissor fashion to the other joint arm, and the cylinder which is disposed so as to be longitudinally displaceable on the piston rod is then articulated with its end facing away from the inlet side of the piston rod so that it is pivotable on the carcass mounting part.

The end articulated on the carcass mounting part is then advantageously closed, so that a piston of which the diameter is substantially equal to the internal diameter of the cylinder can be mounted on the free end of the piston rod, so that the interior of the cylinder is divided into two working spaces which are separated from one another by the piston and vary in volume in opposite directions in the case of a relative displacement of the piston rod and the cylinder, and in which a fluid damping medium can be enclosed. Both a gaseous medium, preferably ambient air, and also a flowable viscous medium may be considered as the damping medium. The damping effect is then achieved by throttled overflowing of the damping medium from the decreasing working space into the increasing working space.

The invention is explained in greater detail in the following description of an embodiment in conjunction with the drawings, in which.

Figure 1:
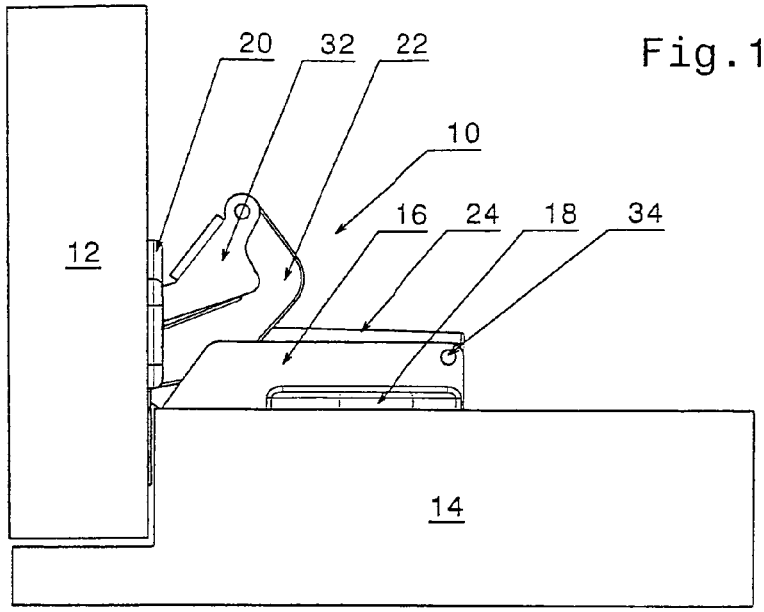
FIG. 1 shows a side view of a universal joint hinge which is constructed in the manner according to the invention and articulates a door leaf on the supporting wall of a cupboard carcass, in the closed position of the door leaf.
Figure 2:
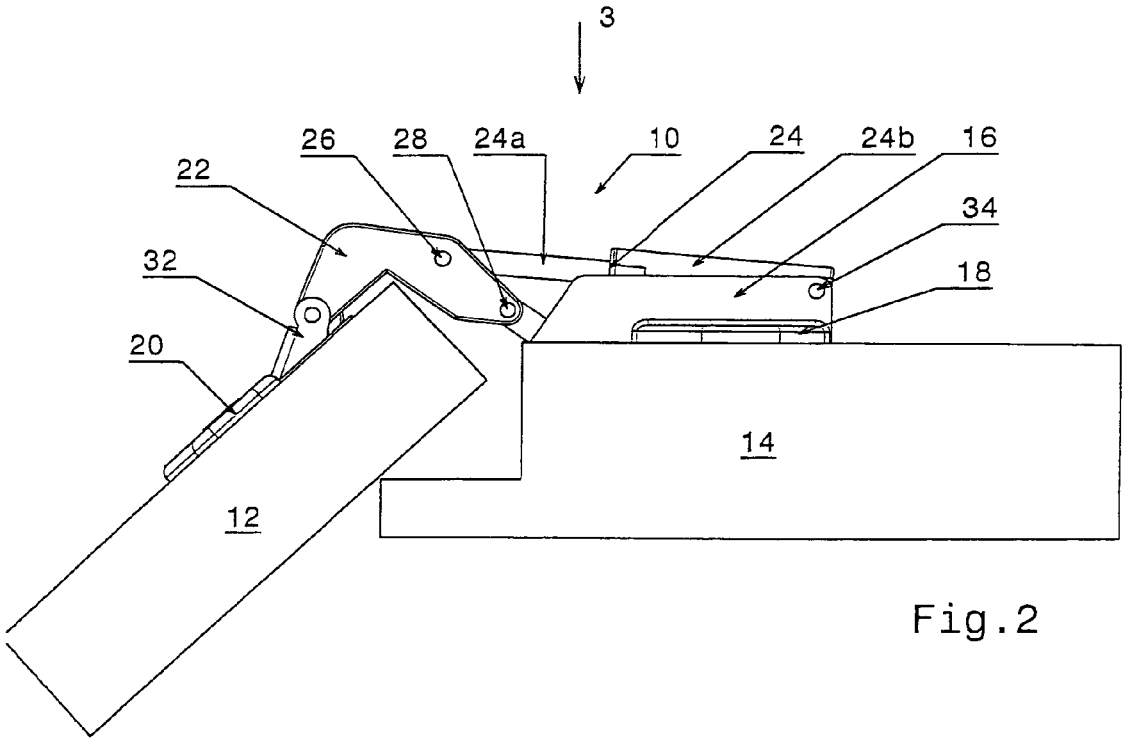
FIG. 2 shows a side view corresponding to that of FIG. 1 in which the door leaf is shown in the fully open position.
Figure 3:
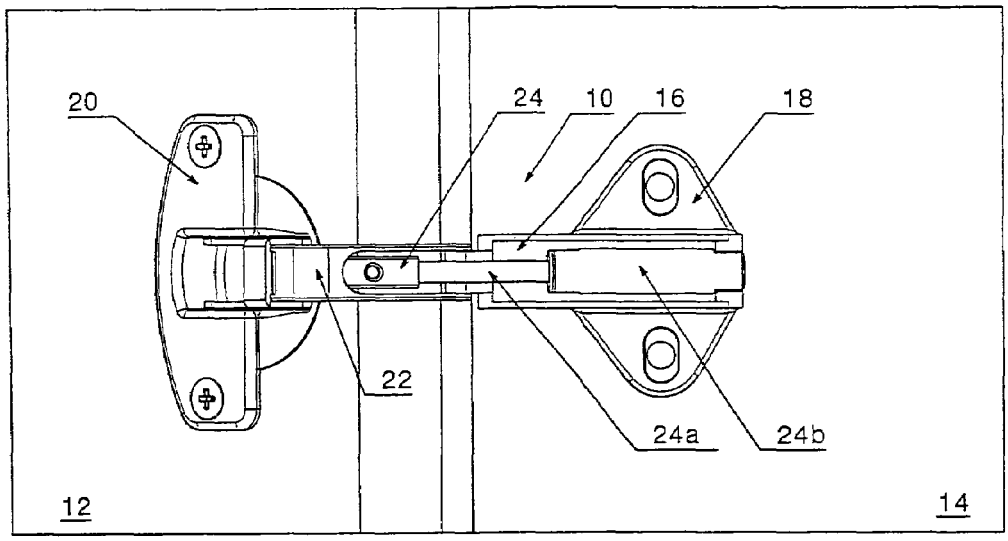
FIG. 3 shows a plan view in the direction of the arrow 3 in FIG. 2.
Figure 4:
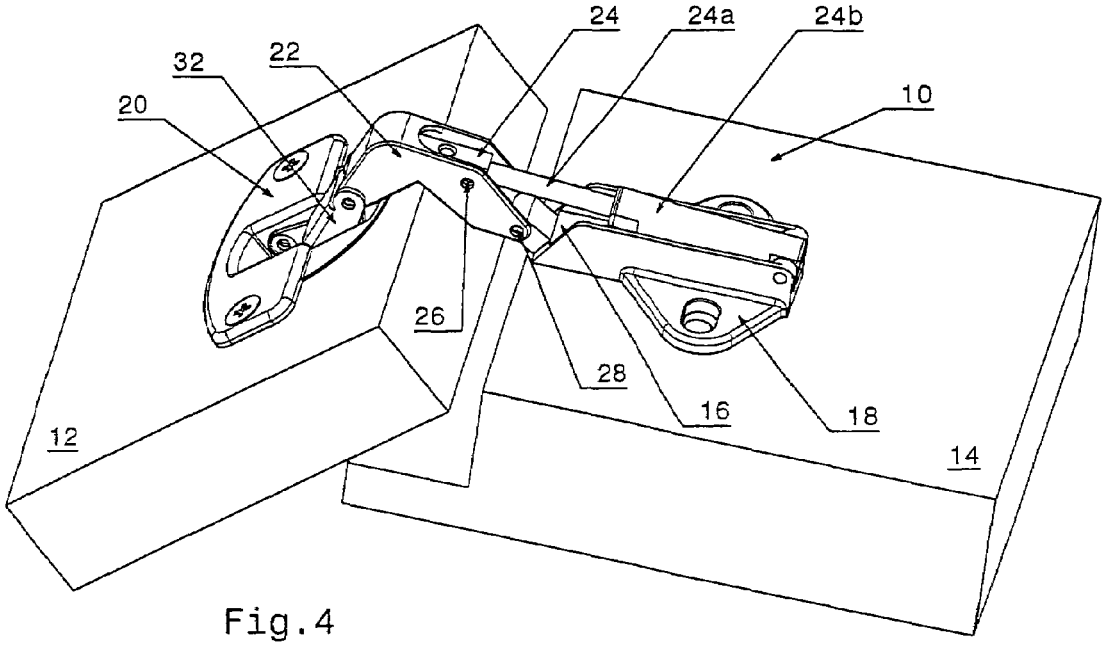
FIG. 4 shows an isometric three-dimensional view in which the hinge according to the invention is shown in the open position of the door leaf which is also shown in FIGS. 2 and 3.

The universal joint hinge according to the invention which is shown in the drawings and is identified as a whole by 10 serves to articulate a door leaf 12 on the supporting wall 14 of the carcass of a piece of furniture. The carcass mounting part 16 of the hinge is fixed on the supporting wall 14 in the usual manner by means of a mounting plate 18. The door leaf mounting part 20 takes the equally common form of a hinge cup which can be fixed in a recess on the rear face of the door leaf 12.

The universal joint mechanism which pivotably couples the carcass mounting part and the door leaf mounting part 20 is formed by two joint arms 22 and 24 which are pivotably connected to one another in their central region by a hinge pin 26. The joint arm 22 is pivotably articulated on the carcass mounting part 16 by means of a bearing journal 28 and the joint arm 24 is pivotably articulated on the door leaf mounting part 20 by means of a bearing journal which is not shown in the drawings. A coupling link 32, which for its part is mounted so as to be pivotable in the door leaf mounting part 20 and guides this end of the joint arm 22 on a circular path, is connected to the other rocking end of the joint arm 22.

The second end of the joint arm is articulated by a bearing journal 34 so as to be directly pivotably on the carcass mounting part 16. The part of the joint arm 24 lying between the hinge pin 26 and the bearing journal 34 is—unlike the known universal joint hinges—composed of two joint arm portions 24*a* and 24*b* of which the joint arm portion 24*a* which is coupled pivotably to the joint arm 22 by the hinge pin 26 is constructed as a piston rod which engages so as to be longitudinally displaceable in the interior of the second joint arm portion 24*b* which is constructed as a cylinder, wherein on the end of the piston rod inside the cylinder a piston—not shown—is inserted which ensures the sliding guiding of the piston rod in the cylinder and forms in the cylinder two working spaces which are separated by the piston and are variable in size and which in practice form the damper spaces for the damper arrangement provided according to the invention.

When a gas, e.g. ambient air, is used as damping medium the damping function is effected by the throttled overflowing of the air enclosed in the working spaces from the decreasing working space into the increasing working space. In this case the overflowing of the air can take place by corresponding passage of the piston in the interior of the cylinder between the piston circumference and the cylinder wall. If need be a channel-like depression in the circumference of the piston or a correspondingly calibrated through bore in the piston can also form the throttle section. Instead of a gaseous damping medium a fluid damping medium of suitable viscosity can also be used, for example a damper oil can be used as damping medium, in which case the inlet region of the piston rod 24*a* into the cylinder 24*b* must be sealed with appropriate care against the escape of the damping medium.

Figure 5:
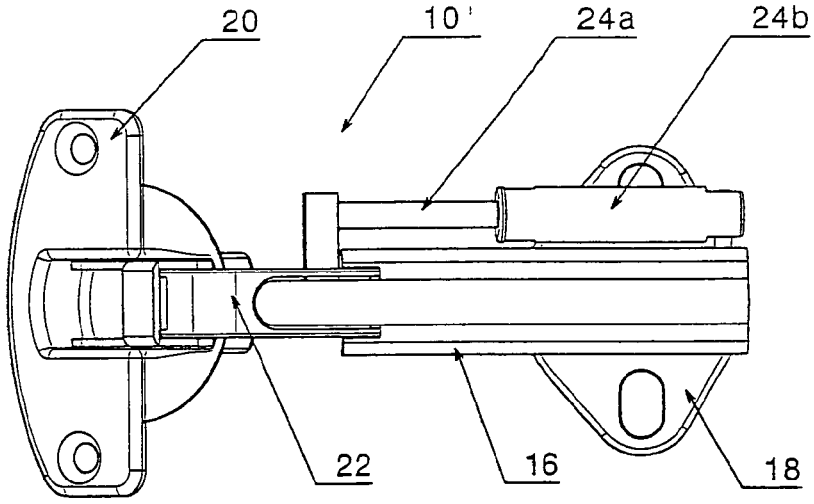
FIG. 5 shows a plan view, corresponding to the illustration in FIG. 3, of a modified embodiment of a universal joint hinge according to the invention.
Figure 6:
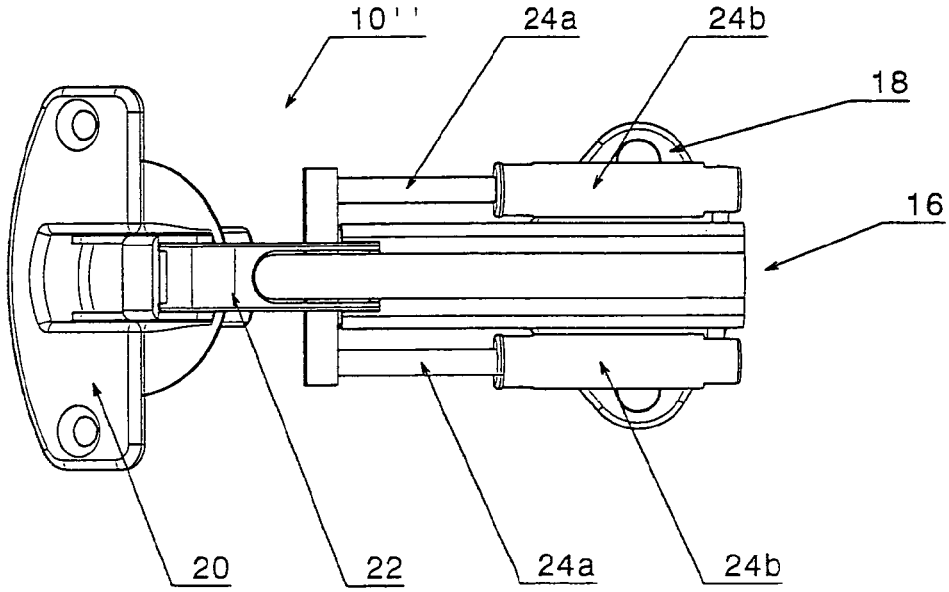
FIG. 6 shows a plan view of a further modified third embodiment of a universal joint hinge according to the invention.

In FIGS. 5 and 6 two embodiments of universal joint hinges 10' and 10" which are constructed according to the invention are shown as modifications of the universal joint hinge 10 described above in connection with FIGS. 1 to 4, and these universal joint hinges correspond basically in construction and function to the universal joint hinge 10, wherein only in the universal joint hinge 10' the cylinder 24*b* and the piston rod 24*a* which is displaceable therein are disposed so as to be laterally offset from their position in the longitudinal central plane of the hinge, so that the interior of the carcass mounting part 16 is accessible from above, e.g. for fixing or adjusting means.

In the further modified universal joint hinge 10" a pair of cylinders 24*b* and piston rods 24*a* are provided in each case on opposing sides of the longitudinal central plane of the hinge 10".

It can be seen that within the scope of the idea underlying the invention further modifications and variants of the described embodiments are possible. Thus the arrangement of the cylinder 24*b* and the piston rod 24*a* according to the described examples can also be replaced in such a way that the free end of the piston rod 24*a* is pivotably articulated on the end portion of the carcass mounting part 16 inside the carcass and accordingly the end of the cylinder 24*b* remote from the piston rod is integrally attached to the central region of the universal joint mechanism which is coupled pivotably like scissors with the other joint arm 22.

The invention claimed is:

1. An universal joint hinge (10) for the articulation of a door leaf (12) on a carcass of a piece of furniture, the universal joint hinge comprising a mounting plate (18) designed to be disposed on a supporting wall (14) of the carcass and formed as an elongated support arm a carcass mounting part (16) mounted on the carcass mounting plate (16);

a universal joint mechanism comprising two joint arms (22; 24), a door leaf mounting part (20), constructed as a hinge cup, is disposed on a door leaf, wherein the two joint arms (22; 24) are pivotably connected to each other in their centers and each joint arm is pivotable at one of its ends about a fixed axis on one of the mounting parts (16; 20) and the respective other end is attached to the respective other mounting part (20; 16) so as to be variable in position along a predetermined space curve extending in a plane lying at right angles to the pivot axis of the hinge, wherein the joint arm (24) is pivotably mounted about a fixed axis on or in the door leaf mounting part (20) at its opposite end coupled to the carcass mounting part (16) so as to be pivotable about a fixed axis on or in the end region of the carcass mounting part (16), and wherein a portion of the joint arm (24*a*) which is positioned between the region which is pivotably mounted on the carcass mounting part (16) and the region which supports the joints arms (22; 24) so that the joints arms (22, 24) pivot approximately centrally comprising two joint arm portions (24*a*; 24*b*) which are longitudinally displaceable relative to one another by a predetermined amount, wherein a damping device, which is effective at least during a part of a displacement movement of the joint arm portions relative to one another is provided between the two joint arm portions (24*a*; 24*b*) and wherein the joint arm portions (24*a*; 24*b*) which are displaceable relative to one another, are constructed so that they engage telescopically, and wherein one joint arm portion (24*b*) is formed by an elongated cylinder which is disposed so as to be longitudinally displaceable on a piston rod which forms the other joint arm portion.

2. The universal joint hinge as claimed in claim 1, wherein the piston rod (24*a*) is attached integrally on the central region pivotably coupled in scissor fashion to the other joint arm (22), and the cylinder (24*b*) which is disposed so as to be longitudinally displaceable on the piston rod (24*a*) is articulated with its end facing away from the inlet side of the piston rod (24*a*) so that it is pivotable on the carcass mounting part (16).

3. The universal joint hinge as claimed in claim 2, wherein the end of the cylinder (24*b*) which is articulated on the carcass mounting part (16) is closed.

4. The universal joint hinge as claimed in claim 1, wherein a piston of which the diameter is substantially equal to the internal diameter of the cylinder (24*b*) is mounted on the free end of the piston rod (24*b*), and that the interior of the cylinder is divided into two working spaces which are separated from one another by the piston and vary in volume in opposite directions in the case of a relative displacement of the piston rod (24*a*) and the cylinder (24*b*), and in which a fluid damping medium is provided.

5. The universal joint hinge as claimed in claim 1, wherein the cylinder (24*b*) is integrally attached on the central region pivotably coupled in scissor fashion to the other joint arm (22), and that the piston rod (24*a*) which is disposed so as to be longitudinally displaceable in the cylinder (24*b*) is pivotably articulated on the carcass mounting part (16) at the free end thereof lying opposite the inlet side into the cylinder (24*b*).

6. The universal joint hinge as claimed in claim 1, wherein the aligned longitudinal central axes of the cylinder (24*b*) and of the piston rod (24*a*) lie in the longitudinal central plane of the hinge (10) extending at right angles to the pivot axis of the hinge.

7. The universal joint hinge as claimed in claim 1, wherein the aligned longitudinal central axes of the cylinder (24*b*) and of the piston (24*a*) are disposed in a plane offset laterally from and parallel to the longitudinal central plane of the hinge (10).

8. The universal joint hinge as claimed in claim 7, wherein in a second plane offset parallel to the opposing side of the longitudinal central plane of the hinge the aligned longitudinal central axes of a second cylinder (24*b*) provided there and of a second piston rod (24*a*) are disposed.

* * * * *